US005088420A

United States Patent [19]

Russell

[11] Patent Number: 5,088,420

[45] Date of Patent: Feb. 18, 1992

[54] WORK STATION

[76] Inventor: Edwin R. Russell, 414 Stirling Highway, Cottesloe, Western Australia, Australia

[21] Appl. No.: 112,739

[22] Filed: Oct. 22, 1987

[30] Foreign Application Priority Data

Oct. 23, 1986 [AU] Australia ..... PH08653

[51] Int. Cl.[5] ..... A47B 57/00

[52] U.S. Cl. ..... 108/106; 108/96

[58] Field of Search ..... 108/96, 94, 101, 137

[56] References Cited

U.S. PATENT DOCUMENTS

| | | | |
|---|---|---|---|
| 108,046 | 10/1870 | Palmenberg | 108/96 |
| 1,232,757 | 7/1917 | Berkey | 108/137 |
| 1,964,124 | 6/1934 | Keller | 108/96 |
| 2,433,748 | 12/1947 | Eide | 108/101 |
| 2,628,141 | 2/1953 | Scheuer | 108/101 |
| 2,669,117 | 2/1954 | Fuhrmann | 108/101 |
| 4,109,961 | 8/1978 | Opsvik | 108/96 X |
| 4,646,655 | 3/1987 | Robolin | 108/101 X |

FOREIGN PATENT DOCUMENTS

| | | | |
|---|---|---|---|
| 594002 | 10/1947 | United Kingdom | 108/96 |

*Primary Examiner*—Peter A. Aschenbrenner
*Attorney, Agent, or Firm*—Ernest A. Beutler

[57] ABSTRACT

A work station having a base the forward side of the base supports a pair of transversely spaced upward extending supports which extend obliquely through the space above the base, the supports supporting an upper platform and an intermediate platform above the base at least one of which is displaceable along the supports.

15 Claims, 3 Drawing Sheets

WORK STATION

BACKGROUND OF THE INVENTION

This invention relates to a work station and in particular a work station which is appropriate for use with a computer terminal.

A difficulty with work stations used in association with computer terminals relates to the ancillary equipment usually associated with such terminals. Such equipment generally comprises a key board, disc drive, visual display unit (VDU) and printer. Each of these items must be located on a work station such that they are readily available for access by an operator in an ergonomically desirable manner and such that they do not inhibit or affect the operation of any one of the other components.

It is an object of this invention to provide a work station which is capable of supporting the various units associated with a computer terminal such that each of the items are readily accessible but do not inhibit the utilisation of any of the other components.

SUMMARY OF THE INVENTION

In one form the invention resides in a work station comprising a base, the forward side of said base having a pair of transversely spaced upwardly extending supports which extend obliquely through the space above the base, the supports supporting an upper platform, and an intermediate platform at least one of which is displaceable along the supports.

According to a preferred feature of the invention it further comprises support brackets slidably mounted on the supports each platform being mounted to the supports by means of a pair of support brackets supported in horizontally opposed relation on the supports, clamping means being provided to clampingly retain the support brackets in position on the supports.

According to a preferred feature of the previous feature the supports are co-linear and said support brackets comprise a mounting member adapted to be slidably engagable with the supports and a support arm extending from the mounting member in a fore aft direction wherein the angles subtended between the direction of slidable movement of the mounting member on the support and the fore aft direction is equal to the angle subtended between the main axis of the support to a horizontal fore aft axis.

According to a preferred feature of the previous features at least one end of one support arm is tubular and is open.

According to a preferred feature of the previous features at least one support arm supports a secondary element through a spigot receivable in said one end.

According to a preferred feature of the invention at least one of said supports accommodates a copy support located between the intermediate platform and an upper platform, said copy support being displaceable along the support and being pivotable thereon.

According to a preferred feature of the invention said copy support is pivotable about an axis parallel with the axis of the support.

According to a further feature of the invention said copy support is pivotally movable between a rearwardly inclined position and a forwardly extending substantially horizontal position.

According to a further preferred feature of the invention said copy support is slidable transversely on the support.

BRIEF DESCRIPTION OF THE DRAWINGS

The invention will be more fully understood in the light of the following description of one specific embodiment. The description is made with reference to the accompanying drawings of which.

DETAILED DESCRIPTION PREFERRED EMBODIMENTS OF THE INVENTION

Figure 1A:
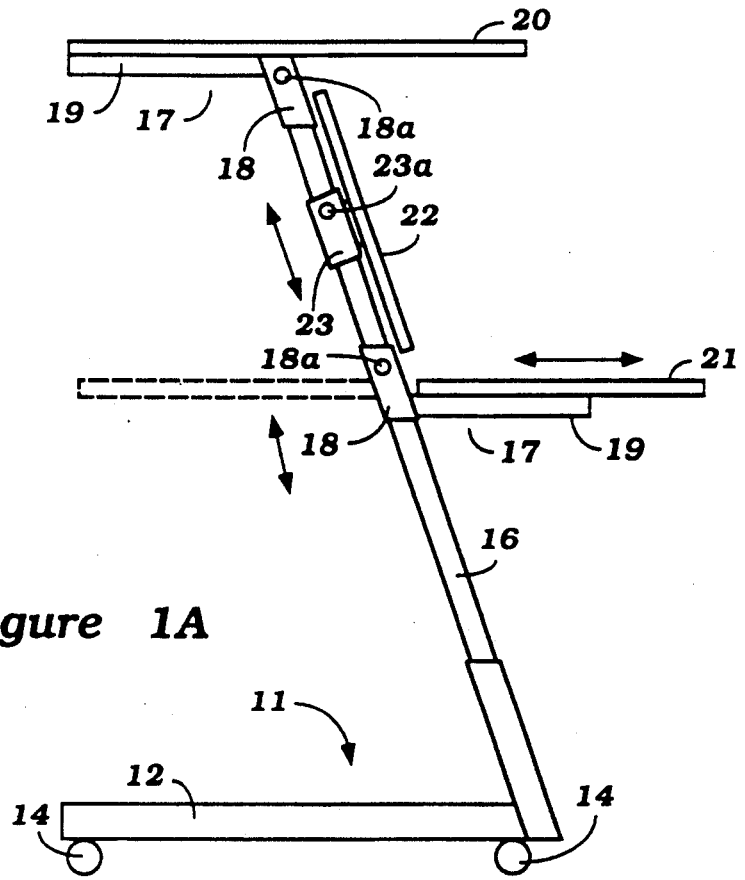
FIG. 1A is a side elevation of one embodiment of the embodiment.
Figure 1B:
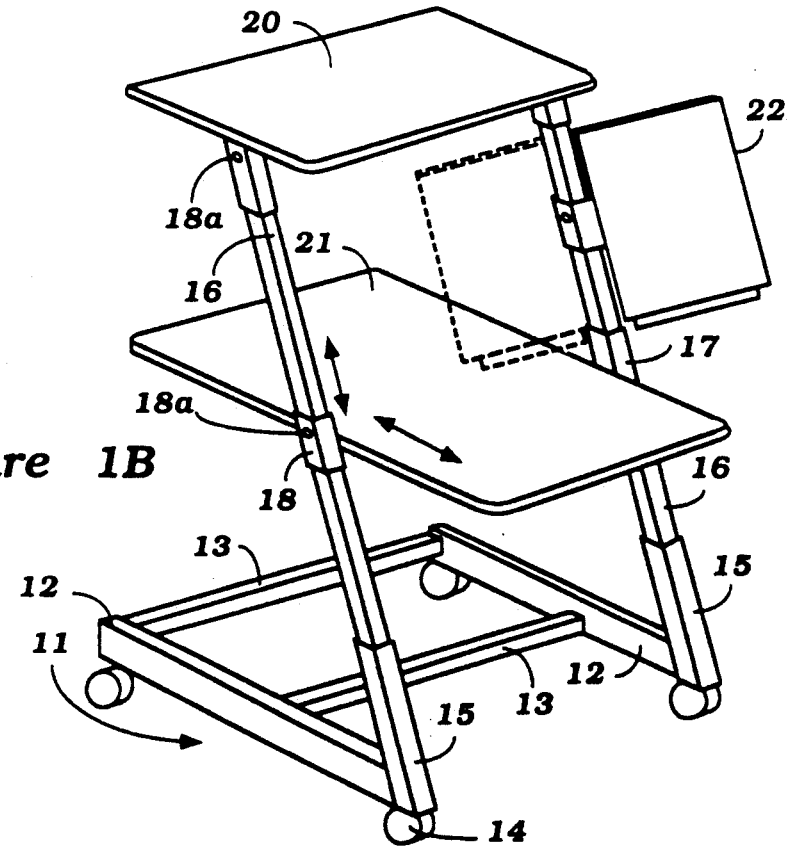
FIG. 1B is an isometric view of a modified form of the work station of FIG. 1A.

The embodiment comprises a work station which can take a modular form and comprises a base 11 formed by a pair of parallel side members 12 which extend in the fore and aft directions and which are interconnected by a pair of parallel struts 13. The base is supported from the group by suitable wheels or castors 14. The front end of the arms 12 each have an upwardly and rearwardly inclined tubular socket 15 mounted thereto. The sockets 15 are substantially parallel and receive a pair of co-linear upstanding supports 16 of the same length. A variety of pairs of supports of differing length may be provided to accommodate for differing work station heights. A suitable adjustable clamping means (not shown) of any suitable means is provided on the sockets to ensure retention of the supports 16 therein. The supports 16 support between themselves a number of platforms which are supported on the supports 16 by a pair of support brackets 17 each received on the respective support 16. The support brackets 17 comprise a tubular member 18 which is slidably receivable over the support and which have affixed thereto an outwardly extending arm 19 which extends substantially horizontally from the tubular member 18 when located on the support 16. An adjustable clamping means **18*a* not shown of any suitable form is provided in the tubular members 18 to facilitate retention on the supports 16. Because of the geometry of the support brackets they may be fixed over the supports 16 to extend horizontally forwardly from the supports or horizontally rearwardly from the supports. To transpose the support brackets from being forwardly to bring reasonably directed or vice versa it is merely necessary to rotate the support bracket 180° about a vertical axis and 180° about the longitudinal axis of the arms 19. By utilisation of support brackets 17 of similar configuration a variety of platforms can be supported in a variety of ways on the supports 16. As shown at FIG. 1 an upper platform 20 may be supported at the upper end of the supports 16 by mounting a panel to the support bracket to overlie one end of the tubular members 18 and the transversely extending arm 19 to prevent slidable movement of the tubular member 18 down the support 16 once the upper end of the support 16 is received within the tubular member 18 and it bears against the underneath of the panel. The intermediate platform 21 and if desired the upper platform is mounted to the transversely extending arms 19 and to one side of the tubular support 18 to facilitate free slidable movement of the tubular member 18 over the supports and such that the intermediate shelf extends between the supports 16 and in a cantilever fashion forwardly and/or rearwardly of the supports 16. If desired the intermediate shelf 21 may be slidable horizontally on the transversely extending arm 19 to be movable forwardly or rearwardly with respect to the support bracket 17 between the solid and broken line views as shown in FIG. 1A by any suitable type of slidable support. As shown at FIG. 1B the intermediate platform 21 may extend to both forwardly and rearwardly of the supports 16 or as shown in FIG. 1A** the intermediate platform may extend to one side only.

If desired the arm 19 of the support brackets may be open at each end and of a polygonal or oval or eccentric cross-section to facilitate the engagement with spigots of corresponding cross-section provided on further elements which may be mounted into the ends of the arms to extend forwardly or rearwardly laterally from the arm.

The form of the embodiment shown at FIG. 1A is capable of supporting a key board on the intermediate platform 21 and a printer together with a VDU and/or disc drive on the upper platform 20. In the case of the modified form shown at FIG. 1B the extended intermediate platform 21 facilitates the location of a VDU or disc drive behind the key board on the intermediate platform 21. If the intermediate platform 21 is mounted to the support brackets by a slidable mounting the intermediate platform together with its contents may be located such that it extends outwardly from the work station when it is required as shown in the solid line view of FIG. 1A and may be moved rearwardly to within the confines of the space above the base of the work station for storage as shown in the broken line view of FIG. 1A.

The supports 16 may individually or jointly support a copy support 22. The copy support 22 may take the form as shown at FIGS. 1A and 1B where it is mounted to one support above the intermediate platform 21 by a tubular member 23 which is slidable on the support and is provided with an adjustable clamping means 23*a* not shown of any suitable form for engagement with the support. The copy support is pivotable about an upright axis which may be parallel with the main axis of the support to be movable between a position directly lying directly above the intermediate platform as shown at FIG. 1A and in broken lines in FIG. 1B or to one side but above the plane of the intermediate platform as shown in solid lines at FIG. 1B.

Figure 2A:
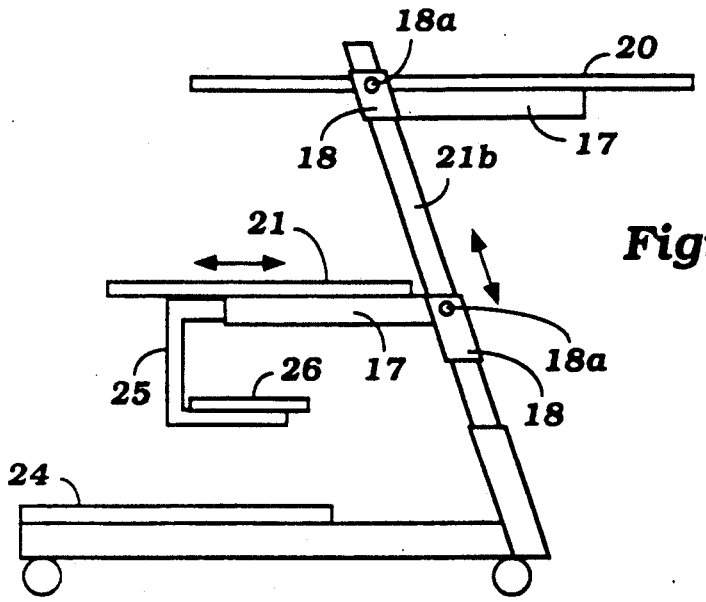
FIG. 2A is a side elevation of a second embodiment.

The embodiment shown at FIG. 2A illustrates a work station whereby the supports 16 of the form shown at FIGS. 1A and 1B are replaced by shorter supports and whereby the top platform 20 is enlarged in the fore and aft axis and may be used to accommodate the key board, and the VDU and/or the disc drive. In addition the top platform 20 is mounted to the brackets to one side of the tubular member 18 in order that the upper platform 20 is slidable along the supports 16. The intermediate platform 21 is located to the rear of the supports 16 and may be used to accommodate a printer in a location which is readily accessible from the rear of the work station but which does not interfere with the operator under normal circumstances. As shown at FIG. 2A the upper surface of the side members 12 of the base may support between themselves a lower platform 24 for accommodation of stationery or other materials.

In addition the free ends of the arms 19 of the brackets 17 are open and the rearmost ends each receive one arm of a U-shaped support 25 such that the other arm lies underneath the intermediate platform and parallel thereto. The lower arm of each U-shaped support 25 support between themselves a further platform 26 which can support the source of, or dump for, continuous stationery associated with a printer on the intermediate platform.

Figure 2B:
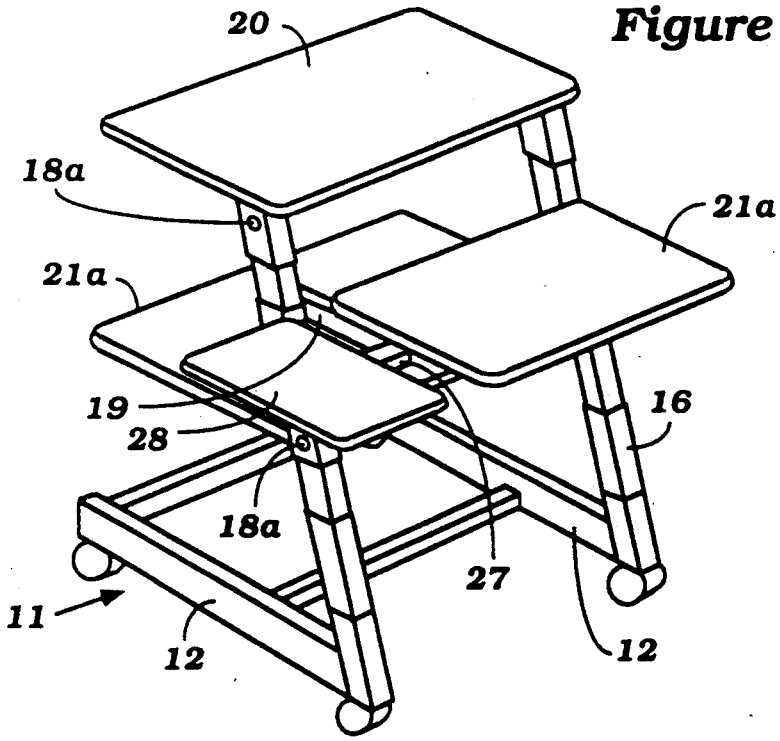
FIG. 2B is an isometric view of a modified form of the work station of FIG. 2A.

The form of the second embodiment shown at FIG. 2B utilises a pair of intermediate platforms 21*a* and 21*b* each supported from a separate pair of support brackets 17. The uppermost intermediate platform 21*a* extends forwardly from the supports 16 and can be used to support a keyboard. The lowermost intermediate platform 21*b* extends rearwardly from the supports 16 and can be used to support a printer. The uppermost platform 20 can be used to support a VDU or disc drive. The ends of the arms 19 of the support bracket 17 supporting the uppermost intermediate platform are open and the forwardmost ends receive the end of a U-shaped, Z-shaped or L-shaped support 27 which is positioned to extend laterally from the platform 28 beside the uppermost intermediate support platform 21*a*.

Figure 3A:
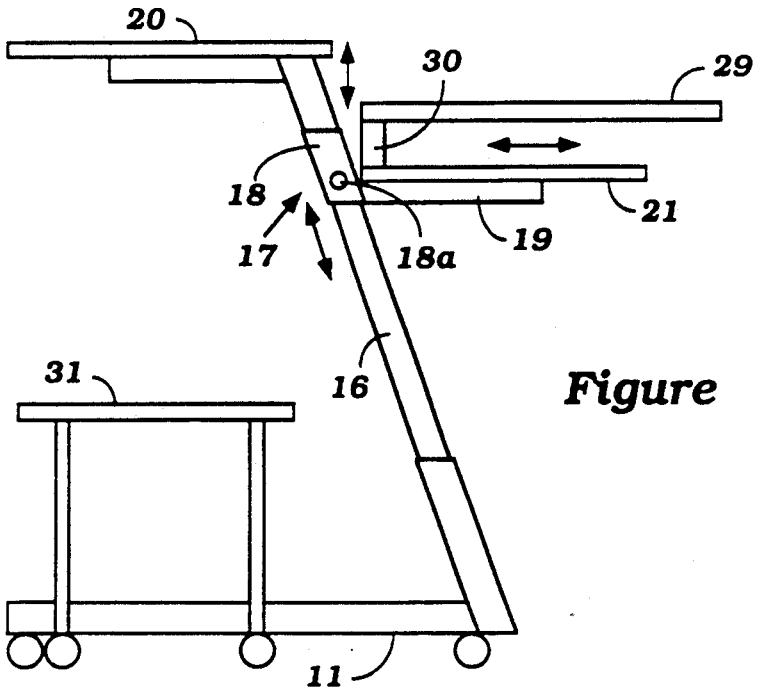
FIG. 3A is a side elevation of a third embodiment.
Figure 3B:
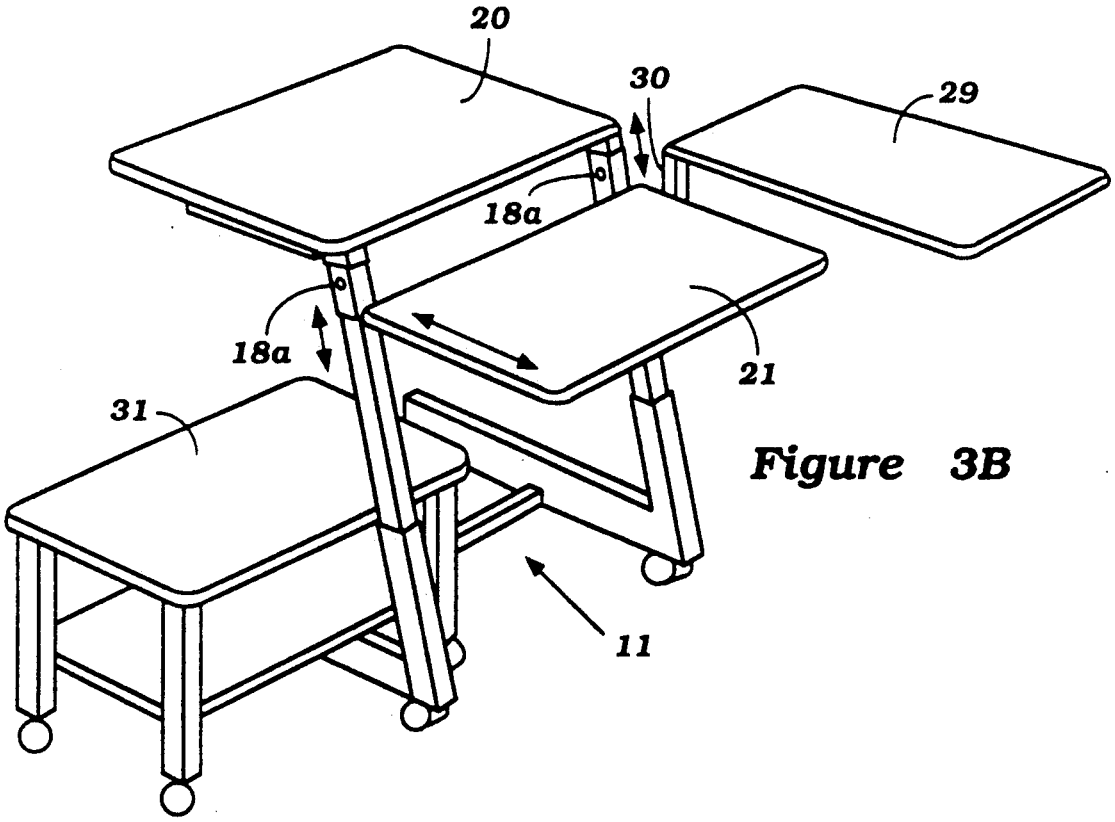
FIG. 3B is an isometric view of the third embodiment.

The third embodiment shown at FIGS. 3A and 3B again utilises the supports 16 which are of a different length from the supports used in the embodiments of FIGS. 1 and 2 and has a modified intermediate platform 21 which has a second support platform 29 pivotally supported at one side of the intermediate platform 21 to be movable between a position shown at FIG. 3A at which it overlies the intermediate platform 21 and a position as shown at FIG. 3B at which it is to one side of the intermediate platform 21. The pivotal support for the second platform is provided by a support sub frame (not shown) fixed to the underneath of the second platform and formed with a downwardly extending tubular socket 30 which is receivable in an upwardly directed spigot (not shown) supported form one end of the support arm 19 of the adjacent support bracket 17 by means of a fitting (not shown) having a portion receivable in one end of the support arm 19. The function of the second platform 29 is to provide a desk support which can overlie the key board on the intermediate platform 21 such that the operator can use the second platform as a writing support or the like when not using the key board. As a result the desk need not be restricted to utilisation with a key board only. As shown at FIGS. 3A and 3B the embodiment may be used in association with other furniture whereby the base 11 may be located below an item of furniture 31 such as a desk or small table which can provide a support for ancillary equipment, stationery, files, etc.

In each of the embodiments described above the copy rest shown at FIGS. 1A and 1B may be replaced by an alternative form of copy rest which is slidably supported on one of the supports 16 by means of a tubular member and is pivotable about a substantially horizontal axis to be movable between a rearwardly inclined position which is substantially parallel with the plane between the supports 16 and a forwardly extending substantailly horizontal position. In addition the copy support is slidable on the support along a transverse axis to be displaceable between a position at which it overlies the intermediate platform 21 and a position to one side thereof.

Each of the embodiments provide a work station which is capable of a number of differing orientations depending upon the requirement of the user and the nature of the installation with which the work station is to be used and which is capable of taking on a desirable ergonomic configuration which is suitable to both the operator and the equipment with which it is used.

It should be appreciated that the scope of the present invention need not be limited to the particular scope of the embodiment described above. The configuration shown in the drawings are described as embodiments of the invention are only examples of the configurations available.

I claim:

1. A work station comprising a base comprised of a pair of generally parallel side members joined at a point spaced rearwardly of their forward ends by a cross member to define a work area therebetween, a pair of transversely spaced upward extending sockets extending from the forward ends of said side members obliquely in a rearward direction from the forwardmost portion of said base, a pair of supports each received in a respective one of said sockets and extending obliquely from the front of said base rearwardly, an upper platform supported by at least one of said supports above said base and an intermediate platform supported by at least one of said supports above said base and below said upper platform, at least one of said platforms being vertically adjustable its respective support along the support.

2. A work station comprising a base comprised of a pair of generally parallel side members joined at a point spaced rearwardly of their forward ends by a cross member to define a work area therebetween, a pair of transversely spaced upward extending supports extending from the forward ends of said side members obliquely in a rearward direction from said base, an upper platform supported by at least one of said supports above said base and an intermediate platform supported by at least one of said supports above said base and below said upper platform, at least one of said platforms being vertically adjustable its respective support along the support, said platforms being supported by pairs of support brackets slidably mounted on said supports, and clamping means for clampingly retaining said support brackets in position on said supports.

3. A work station as claimed at claim 2 wherein the support brackets each comprise a mounting member adapted to be slidably engageable with the respective support and a support arm extending horizontally from the mounting member.

4. A work station as claimed at claim 3 wherein the mounting member is tubular and is slidably receivable over the support.

5. A work station as claimed at claim 3 wherein at least one end of the support arm is tubular and is open for attachment of a further component in each open end.

6. A work station as claimed at claim 5 wherein the at least one support arm supports the further component through a spigot receivable in said one end.

7. A work station as claimed at claim 6 wherein the further component comprises a further platform supported from the at least one support bracket.

8. A work station comprising a base comprised of a pair of generally parallel side members joined at a point spaced rearwardly of their forward ends by a cross member to define a work area therebetween, a pair of transversely spaced upward extending supports extending from the forward ends of said side members obliquely in a rearward direction from said base, an upper platform supported by at least one of said supports above said base and an intermediate platform supported by at least one of said supports above said base and below said upper platform, at least one of said platforms being vertically adjustable its respective support along the support, at least one of said supports accommodating a copy support for supporting material to be copied located between said intermediate platform and said upper platform, said copy support being displaceable along the support and being povitable thereon.

9. A work station as claimed at claim 8 wherein the copy support is pivotable about an axis parallel with the axis of the support.

10. A work station as claimed at claim 9 wherein the copy support is pivotably movable between a rearwardly inclined position and a forwardly extending substantially horizontal position.

11. A work station as claimed at claim 10 wherein said copy support is slidable transversely on the support.

12. A work station as claimed at claim 3 wherein at least one of said supports accommodates a copy support located between the intermediate platform and the upper platform said copy support being displaceable along the support and being pivotable thereon.

13. A work station as claimed at claim 12 wherein the copy support is pivotable about an axis parallel with the axis of the support.

14. A work station as claimed at claim 13 wherein the copy support is pivotably movable between a rearwardly inclined position and a forwardly extending substantially horizontal position.

15. A work station as claimed at any claim 14 wherein said copy support is slidably transversely on the support.

* * * * *